United States Patent [19]

West

[11] 4,058,197

[45] Nov. 15, 1977

[54] RIBBON TENSION CONTROL FOR A RIBBON CARTRIDGE

[75] Inventor: Donald P. West, Dallas, Tex.

[73] Assignee: Xerox Corporation, Stamford, Conn.

[21] Appl. No.: 727,107

[22] Filed: Sept. 27, 1976

Related U.S. Application Data

[63] Continuation of Ser. No. 537,148, Dec. 30, 1974, abandoned.

[51] Int. Cl.[2] ..... B41J 33/52

[52] U.S. Cl. ..... 197/151; 242/75.4

[58] Field of Search ..... 35/8 A, 35 C; 197/151, 197/168, 172, 180; 242/71.2, 75.4, 84.8, 197, 198, 199, 200

[56] References Cited

U.S. PATENT DOCUMENTS

| | | | |
|---|---|---|---|
| 1,883,222 | 10/1932 | Wood | 242/75.45 |
| 1,960,517 | 5/1934 | Taylor | 242/75.45 |
| 3,481,445 | 12/1969 | Engle et al. | 197/151 |
| 3,604,549 | 9/1971 | Caudill et al. | 197/151 |
| 3,612,242 | 10/1971 | Cassell et al. | 197/151 |
| 3,762,615 | 10/1973 | McCallister | 242/156 X |
| 3,877,561 | 4/1975 | Guerrini et al. | 197/151 |

*Primary Examiner*—Edgar S. Burr
*Assistant Examiner*—Paul T. Sewell

[57] ABSTRACT

A ribbon tension control for a ribbon cartridge comprising a shaped frictional drag device in frictional contact with the edges of at least one side of the ribbon material situated on the supply spool. The frictional drag device is in the form of a semi-circular section with an additional section extending outwardly from the center of the outer circumference of the semi-circular section. The additional section decreases in width from the semi-circular section to the outside dimension of the ribbon material. The center of the semi-circular portion is coaxial with the ribbon supply spool.

9 Claims, 9 Drawing Figures

RIBBON TENSION CONTROL FOR A RIBBON CARTRIDGE

This is a continuation of application Ser. No. 537,148, filed Dec. 30, 1974, now abandoned.

CROSS REFERENCE

This case includes similar disclosure to a copending application Ser. No. 702,330 filed concurrently herewith, entitled "Web Tension Control."

BACKGROUND OF THE INVENTION

This invention relates in general to web tension-control apparatus and more particularly to tension-control apparatus for ink ribbons employed in serial printer applications.

In devices in which any web material is to be delivered or transferred from a rotatable reel, drum, spool, spindle or a like receptacle to another similar and compatible receptacle, it is normally necessary to provide means for maintaining a certain amount of tension in the web material during its deliverence. Tension is desired in the web material for economic reasons and user acceptance during the transfer so that a greater amount of web material may be placed on each receiving receptacle and so the web material will be tightly wound on the receiving receptacle and will not fall therefrom during handling. In addition, it is desired to provide means to brake the supply receptacle in the event the web material breaks so the supply receptacle will not continue to feed the web material. In the particular environment of ink ribbons employed in serial printers, a certain amount of tension is required for proper ribbon feed and acceptable print quality of the printed material.

Although the invention is applicable to various web, tape, strand and ribbon-like materials, it has been found particularly useful in the environment of ink ribbons as used in serial printers. Therefore, without limiting the meaning of the word "ribbon," the invention will be described in this environment.

As any web material is delivered between a pair of reels, drums, spools, spindles, etc., the tension therein will tend to vary due to geometrical and inertial changes. In a serial printer ribbon system, a certain amount of variation in the tension in the ribbon does not adversely affect the ribbon feed or the print quality. In order to wind an ink ribbon onto its take-up spool, it is necessary to apply a force to the take-up spool. The amount of force required will vary and be dependent upon the amount of ink ribbon presently on the take-up spool. The force normally applied will be the value which will be required to rotate the take-up spool when the maximum diameter of the ink ribbon is wound on the take-up spool. Thus, without some compensation in the system, when only a small amount of the ink ribbon has been wound on the take-up spool, the force applied to the take-up spool is much greater than required and results in a greater tension existing in the ink ribbon than when the take-up spool is nearly full of ink ribbon. A fabric ribbon is less susceptible to changes in tension than the matrix type plastic ribbon since it does not stretch nor break as easily and it more easily conforms to the physical shape of the character during the printing action.

An excessive amount of tension in the ribbon can cause the ribbon to stretch and wrinkle and/or fold over onto itself about the deformed center portion or to break, all of which obviously affect the print quality. Also, an excessively low ribbon tension can allow the ribbon to move from its print position to a degree which causes partial or total loss of printing of characters.

It is well known in the art to continuously vary the braking of the wind-off reel in dependence of the tension in the wound-off web material and to rapidly stop the wind-off reel in case of disruption of the web material as disclosed in U.S. Pat. No. 3,243,137. It is also known to use a pawl and ratchet brake device as disclosed in U.S. Pat. No. 3,442,366 to control ribbon tension in an incrementing ribbon feed system. In U.S. Pat. No. 3,621,968, a roller and spring arrangement is disclosed to provide tension in an endless ribbon within a ribbon cartridge. In U.S. Pat. No. 3,797,773, apparatus is disclosed for maintaining tension in a ribbon, which is being wound on an intermittently driven take-up spool by the use of a reed switch (having a tapered shunt) to control a motor which drives the take-up spool. U.S. Pat. Nos. 531,402, 1,340,710 and 1,364,259 disclose various type brake-drag means applied to the side of spool to provide brake and/or tension in the material.

Such prior art solutions have utilized mechanical or a combination of mechanical/electrical means to provide the necessary control of the tension in the web material.

With these prior art problems in mind, it is an object of the present invention to maintain the tension in a ribbon-like member substantially uniform during its transfer from a supply spool to a take-up spool.

Another object of this invention is to improve feeding and braking of web material transferred between two spools or reels.

Yet, another object of this invention is to improve the performance of ink ribbons contained in cartridges of the type used in serial printers.

A further object of this invention is to shape a drag-pad friction device operating on the side of a reel or spool of material in a highly efficient configuration.

Still a further object of the current invention is the construction of an economical method and apparatus for braking ink ribbons for serial printers.

Other objects and advantages will be evident from the specification and claims and the accompanying drawing illustrative of the invention.

BRIEF DESCRIPTION

These and other objects of the present invention are accomplished by a frictional drag means in frictional contact with the edge of ribbon material located on a supply spool. As the amount of ribbon material remaining on the supply spool decreases, the value of the force due to the shaped frictional drag means also decreases. The tension in the ribbon depends upon the frictional force of each incremental area of the shaped frictional drag means in contact with the edge of the ribbon, multiplied by the radius from the center of the reel for each incremental area. The sum of these products, divided by the outside radius of the reel (at any instant of time) is a measure of the ribbon tension. The shaped frictional surface of the frictional drag means which bears on the edge of the ribbon material can be any material which has an approximately constant coefficient of friction. Preferred materials are of felted or fibrous structure, since experience has shown that this structure tends to minimize the difference between static and sliding friction. A cellular or sponge-like material will have similar properties. The frictional drag means is shaped to provide substantially constant tension in the ribbon material from a full supply spool to an empty supply spool as the torque changes when the ribbon material goes from a full supply spool to an empty supply spool.

DESCRIPTION OF THE DRAWING

Other advantages and features of the present invention may become more apparent from reading the following detailed description in connection with the drawing forming a part thereof, in which.

DETAILED DESCRIPTION

Figure 1A:
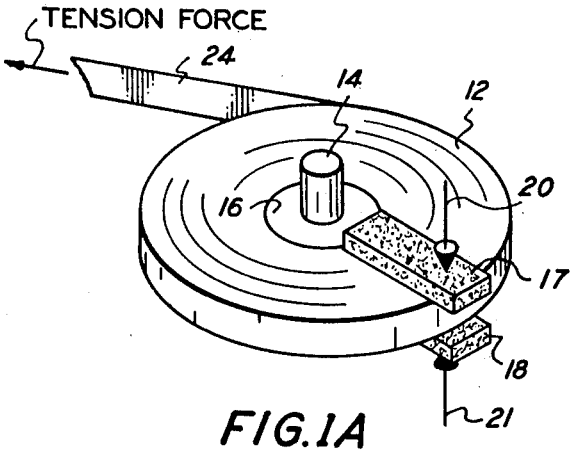
FIG. 1A is a perspective view of one embodiment according to the invention herein.
Figure 1B:
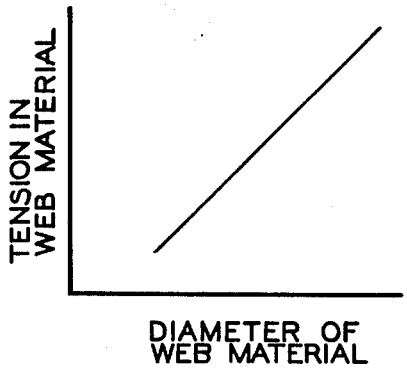
FIG. 1B is a graph of tension in versus diameter of web material shown in FIG. 1A.

Referring now to the drawing and more particularly to FIG. 1A, there is shown one embodiment of the web tensioning means of the present invention. The web or ribbon material 12 is wound on supply spool 16 which is mounted for rotation on shaft 14. Frictional drag means 17 and 18 are in frictional contact with the upper and lower edges of material 12 due to forces 20 and 21 pressing thereagainst. As a force is applied to the end 24 of the web material causing the web material to be removed from the supply spool 16, tension is caused to exist in that portion of the web material extending from the spool of the web material 12 because of the resistance of the frictional drag means 17 and 18 to the unwinding of the web material. The tension in the web material depends upon the frictional force of each incremental area of the frictional drag means 17 and 18, in contact with the edges of the web material 12, multiplied by the radius from the center of the spool 16 for each incremental area. The sum of these products, divided by the outside radius of the spool 16 (at any particular time) is a measure of the ribbon tension. As is shown in FIG. 1B, the rectangular shape of the frictional drag means did not provide a totally constant tension even though the frictional drag means did provide values of tension in the web material which is certainly tolerable for many applications.

Figure 2A:
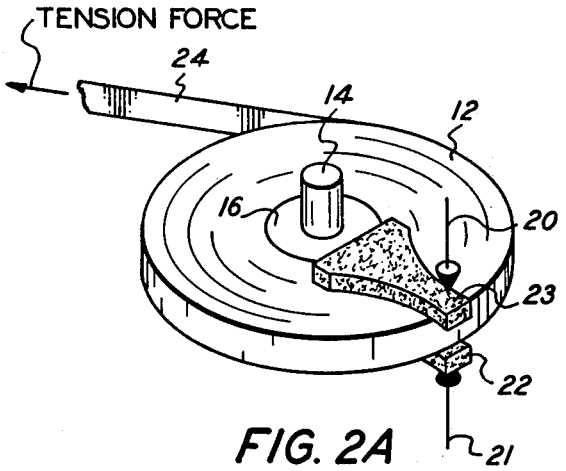
FIG. 2A is a perspective view of another embodiment according to the invention herein.
Figure 2B:
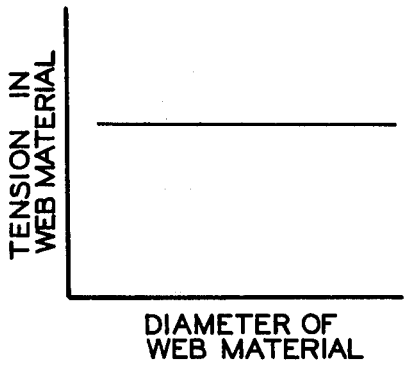
FIG. 2B is a graph of tension in versus diameter of web material shown in FIG. 2A.

As shown in FIG. 2A, the shape of the frictional drag means was changed such that less area of the frictional drag means contacted the edges of the web material which are located further from the center of the spool. The angle covered by the generally curved portions describing the outline of the tapered section of the frictional drag means as it progresses outwardly from the center of the ribbon spool varies inversely to the square of the radius. This is discussed in more detail on Pages 9 and 10. This results, as shown in FIG. 2B, in a substantially constant value of tension in the web material.

Depending upon the materials involved, the tension desired and the particular environment to be considered, the shape of the frictional drag means may be altered to provide the desired tension in the web material. If the web material is very loosely wound on the supply spool without flanges, it is desirable to apply in a symmetrical manner the drag forces due to the frictional drag means by providing said means to both edges of the web material. If the supply spool has a flange on one side, then the drag forces can and need be only applied to one edge of the web material, since the flange will maintain the web material on the supply spool. The matrix type plastic ribbon is normally wound onto the supply spool (without flanges) with a sufficient degree of tightness that the frictional drag force can be applied on only one side edge.

Figure 3:
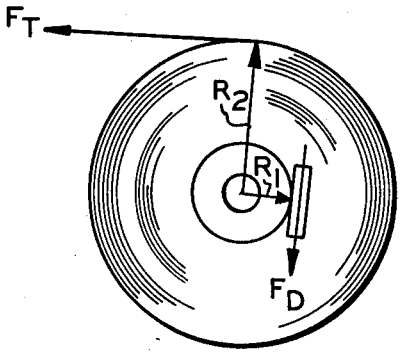
FIG. 3 is a plan view of an exemplary ribbon supply spool and the existing torque forces acting thereon.

The main problem with frictional drags employed in the prior art is that the frictional drag force is applied to some portion of the supply spool or the mounting shaft which results in a constant torque system. A constant torque system is not desired where a substantially constant tension is desired in the web material. With reference to FIG. 3, it will be shown why the prior art which employed frictional drag could not provide a substantially constant tension in the web material. In FIG. 3, $F_D$ is the frictional drag force applied to some portion of the supply spool and $F_D$ is applied at a constant distance of $R_1$. $F_T$ is the force applied to the free end of the web material in order to remove it from the supply spool and $F_T$ is applied at a distance $R_2$. In equation form, the torque equation is:

$$F_T \cdot R_2 = F_D \cdot R_1 \qquad (1)$$

Since $F_D \cdot R_1$ is a constant and $R_2$ decreases in value as the web material is removed from the supply spool, $F_T$ must increase as $R_2$ decreases in order to satisfy the equation. As $F_T$ increases, the tension in the web material increases rather than remains substantially a constant value as is desired.

Figure 5:
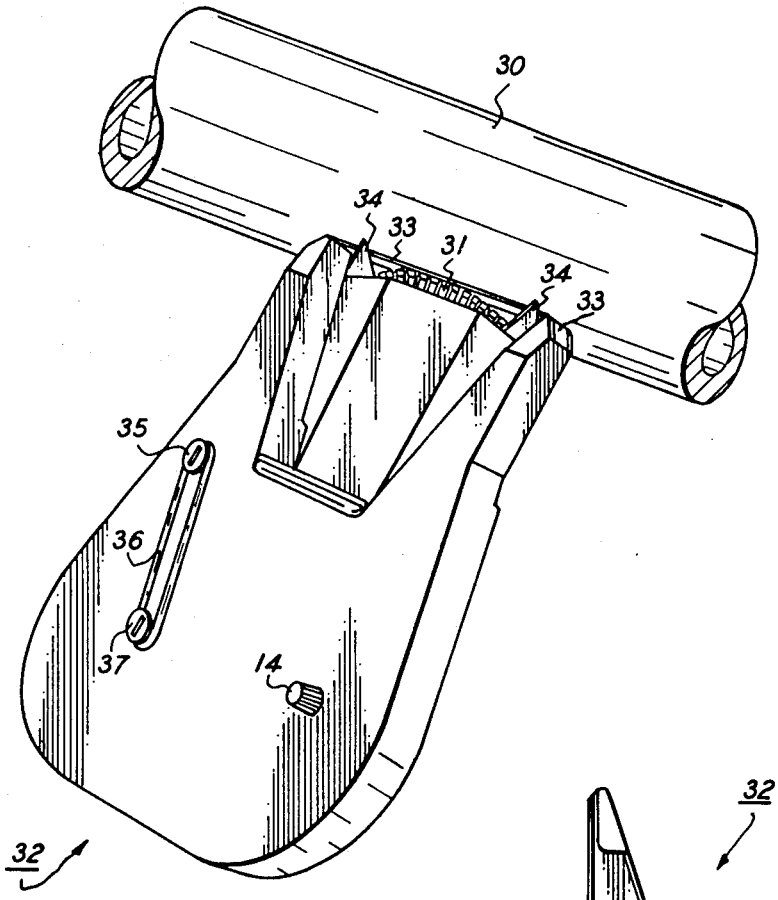
FIG. 5 is a perspective view of a serial printer and ribbon cartridge employing the invention.

In the prior art ribbon cartridge used in the serial printer depicted in FIG. 5, the drag means employed in conjunction with the ribbon supply spool consisted of a rubber O-ring mounted on the ribbon supply spool shaft 14 inside the ribbon cartridge. Due to the construction of the ribbon cartridge 32, pressure was applied to the O-ring by the hub of the ribbon supply spool on one side and by the flat bottom portion of the ribbon cartridge on the other side. The pressures applied against the O-ring caused a frictional drag against the hub of the ribbon supply spool. In order to maintain the tension in the ribbon within reasonable limits during the transfer of the ribbon from a full supply spool to an empty supply spool, it was necessary to depend upon the wear characteristics of the O-ring to change to a degree which would reduce the drag as the ribbon supply spool was emptied of ribbon. The ribbon 33 is wound on the hub of the take-up spool mounted on shaft 37 which is driven by belt 36 and shaft 35. A ribbon advance motor (not shown) intermittently drives shaft 35. The tension in ribbon 33 must be properly maintained while traversing between ribbon guides 34 and in front of print wheel 31 in order for acceptable printing to occur. If the O-ring did not maintain sufficient drag, then the ribbon would fall from the print position in front of the print wheel 31. If the O-ring provided an excessive amount of drag, then the ribbon would stretch, curl and/or break resulting in unacceptable print quality or a complete loss of printed characters. The O-ring method of maintaining tension in the ribbon is satisfactory but the present invention offers a better solution.

In arriving at the ultimate shape of my invention to incorporate in the ribbon cartridge of the serial printer shown in FIG. 5, the following calculations were made.

Starting with the basic equation:

$$W(\text{torque}) = R(\text{radius}) \times T(\text{tension}) \quad (2)$$

A differential change in torque is then expressed as:

$$dW = R \cdot dT + T \cdot dR \quad (3)$$

If tension is to be constant, then dT must equal 0. Substituting into (3) gives:

$$dW = T \cdot dR \quad (4)$$

Figure 4:
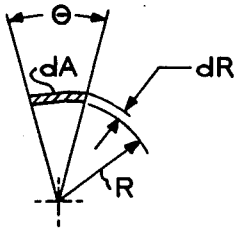
FIG. 4 is a sketch used in the calculation of the optimum shape of the frictional drag means.

To determine the torque supplied by this invention when placed against the edge of the ribbon, reference is made to FIG. 4.

$$dW = K' \cdot dA \cdot R \quad (5)$$

Where K' is a proportionality factor $$dW = K' \cdot (R \cdot \theta \cdot dR) \cdot R \quad (6)$$

$$dW = K' \cdot R^2 \cdot \theta \cdot dR \quad (7)$$

Substituting for equation (4) gives:

$$TdR = K'R^2\theta dR \quad (8)$$

Simplifying gives:

$$T = K'R^2\theta \quad (9)$$

$$\theta = T/(F'R^2) = (K/R^2) \quad (10)$$

Equation (10) shows that the angle which the frictional drag means should cover, as it progresses outwardly from the center of the ribbon spool, varies inversely to the square of the radius. If $R = 1$ unit, then $\theta_1 = K$. If $R = 2$ units, then $\theta_2 = \theta_1/4$. If $R = 3$ units, then $\theta_3 = \theta_1/9$. The largest angle which the frictional drag means may cover when R is small (near the center of the ribbon) is obviously 360°; therefore, experimental tests were conducted in order to determine the shape of the invention near the center of the ribbon spool.

Figure 6:
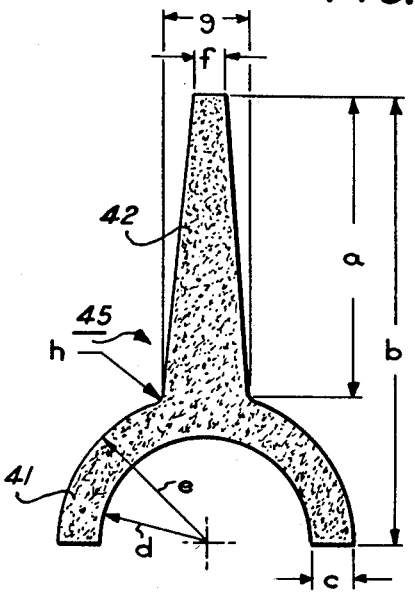
FIG. 6 is a plan view of the invention employed in the ribbon cartridge.

The exact shape of the frictional drag means 45 as used in the ribbon cartridge of FIG. 5 is shown in FIG. 6 and comprises a narrow semi-circular section 41 whose outside radius (*e*) is approximately 0.4 inches and whose inside radius (*d*) is approximately 0.28 inches providing a width (*c*) of approximately 0.12 inches. Extending outwardly from the semi-circular section is a tapered section 42 (a straight line approximation of the theoretical value) which extends a length (*a*) of approximately 0.75 inches from the outer edge of the semi-circular section 41. The width 9 of the tapered section 42 at its base at the semi-circular section 41 is approximately 0.24 inches while the width (*f*) of the tapered section at its outer extremity is approximately 0.12 inches. The overall length (*b*) of the frictional drag means 45 is 1.15 inches and is used with spools of ribbon material which vary from approximately 2.1 inches to 2.2 inches for a full spool. The thickness of the frictional drag means 45 is 0.188 inches.

Different materials were tested for use as the frictional drag means for the ribbon cartridge. Foam plastic (Rodger RFF-263) and 4 lb./cu.ft. ester-type non-reticulated polyester foam with 60 pores/inch (Scott 4 lb. custom foam) were both found to be satisfactory materials for the environment in the ribbon cartridge shown in FIG. 5.

Figure 7:
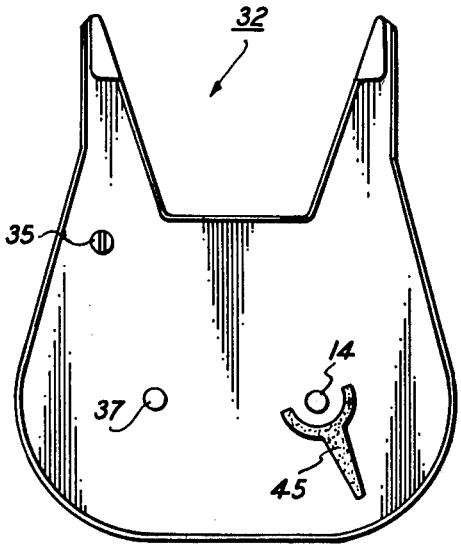
FIG. 7 is a partial plan view of the ribbon cartridge showing the frictional drag means therein.

As shown in FIG. 7, the frictional drag means 45 is positioned and oriented within the ribbon cartridge 32 with the center of the semi-circular section 41 being coaxial with the ribbon supply spool shaft 14. The tapered section 42 is positioned at the 5 o'clock position with respect to the ribbon supply spool shaft 14. The ribbon material is removed from the spool at about the 12 o'clock position with respect to the ribbon supply spool shaft 14. The orientation of the tapered section 42 does not appear to be critical but was decided upon due to convenience of locating and fastening the frictional drag means 45 to the inside of the bottom of the ribbon cartridge 32 and to its successful operation at this location. The frictional drag means 45 is fastened to the inside of the ribbon cartridge 32 with adhesive with the ribbon supply spool then being inserted into the ribbon cartridge over the supply spool shaft 14. The ribbon material is wound on a core which is approximately 0.688 inches in diameter which allows a thin semi-circular portion (approximately 0.064 inches in radial dimension) of the core to rest on the semi-circular section 41 of the frictional drag means 45 at all times, regardless of the amount of ribbon material still remaining on the supply spool; the result being that there is a minimum constant tension in the ribbon material even as the amount of ribbon material on the supply spool approaches zero. When the top of the ribbon cartridge is installed onto the ribbon cartridge, the top presses against the ribbon supply spool and provides the necessary force existing between the frictional drag means 45 and the lower edges of the ribbon material.

With reference to FIG. 5, the ribbon cartridge 32, print wheel 31, ribbon guides 34, ribbon advance motor (not shown), print hammer (not shown) and ribbon lift (not shown) are all mounted on a movable carriage (not shown) for traversing the print line. Prior to printing, the portion of the ribbon cartridge 32 near the platen 30 is pivoted upward to position the ribbon at the print station between the character slugs of the print wheel 31 and the platen 30. After printing the ribbon cartridge 32 is pivoted downward to its non-print position so the operator can view the printed character.

It is, therefore, evident that there has been provided in accordance with this invention a frictional drag means for web material that fully satisfies the objects, aims and advantages set forth above. While the principles of the invention have been made clear in the illustrative embodiment, it is apparent that alternatives, modifications and variations will be evident to those skilled in the art. Accordingly, it is intended to embrace all alternatives, modifications and variations as fall within the spirit and broad scope of the appended claims.

What is claimed is:

1. In a serial printer having a platen, a laterally movable carrier for traversing a printing line, printhead means supported on said carrier for impacting with said platen to print characters, ribbon feed means supported on said carrier for feeding an ink ribbon past said printhead means, and a ribbon cartridge supported on said carrier, wherein said ribbon cartridge includes means for rotatably supporting a ribbon supply spool, means for rotatably supporting a ribbon take-up spool and means for transferring said ribbon between said supply spool and said take-up spool; the improved ribbon tension control comprising:

a stationary frictional drag means extending radially across and positioned in frictional engagement with all the edges of at least one side of the ribbon positioned on the supply spool, said frictional drag means being of a shape to effect a substantially uniform tension in said ribbon during its transfer, said shape comprising a generally curved section which is coaxial with the ribbon supply spool and a straight-line tapered section extending radially outwardly from the generally curved section and extending approximately to the periphery of the ribbon material on the supply spool, the generally curved section having a width in the radial direction of about 0.16 times the width in the radial direction of the tapered section and said tapered section having a width in the circumferential direction of the spool which decreases by a factor of about 0.5 from its inner extremity to its outer extremity, said generally curved section is positioned against said spool to provide a predetermined area of contact between said spool and said generally curved section regardless of the amount of ribbon remaining on said spool.

2. Apparatus according to claim 1 wherein said generally curved section of the frictional drag means covers an angle of 360°.

3. Apparatus according to claim 1 wherein said generally curved section of the frictional drag means covers an angle less than 360°.

4. Apparatus according to claim 1 wherein said generally curved section is circular.

5. Apparatus according to claim 1 wherein said frictional drag means is formed of a fiberous material.

6. Apparatus according to claim 1 wherein said frictional drag means is formed of a felted material.

7. Apparatus according to claim 1 wherein said frictional drag means is formed of a polyester foam material.

8. Apparatus according to claim 1 wherein said generally curved section has an inside radius of approximately 0.28 inches and an outside radius of approximately 0.4 inches.

9. Apparatus according to claim 1 wherein said tapered section has a width of approximately 0.24 inches at its base and a width of approximately 0.12 inches at its outer extremity.

* * * * *